US009403544B2

(12) United States Patent
Beutler

(10) Patent No.: US 9,403,544 B2
(45) Date of Patent: Aug. 2, 2016

(54) INTERACTIVE SPEED CONTROL

(71) Applicant: Joerg Beutler, Holzkirchen (DE)

(72) Inventor: Joerg Beutler, Holzkirchen (DE)

( * ) Notice: Subject to any disclaimer, the term of this patent is extended or adjusted under 35 U.S.C. 154(b) by 0 days.

(21) Appl. No.: 14/247,473

(22) Filed: Apr. 8, 2014

(65) Prior Publication Data

US 2014/0309822 A1 Oct. 16, 2014

(30) Foreign Application Priority Data

Apr. 16, 2013 (EP) ..... 13163907

(51) Int. Cl.
*B61L 23/00* (2006.01)
*A63G 7/00* (2006.01)

(52) U.S. Cl.
CPC ..... *B61L 23/005* (2013.01); *A63G 7/00* (2013.01)

(58) Field of Classification Search
None
See application file for complete search history.

(56) References Cited

U.S. PATENT DOCUMENTS

| | | | | |
|---|---|---|---|---|
| 6,170,402 | B1 | 1/2001 | Rude et al. | |
| 8,636,600 | B2 * | 1/2014 | Howard | A63G 7/00 104/77 |
| 8,894,492 | B2 * | 11/2014 | Ackley et al. | 463/42 |
| 2004/0077415 | A1 * | 4/2004 | Kleimeyer | A63G 9/00 472/1 |
| 2004/0092322 | A1 * | 5/2004 | Fea | A63G 7/00 472/27 |
| 2007/0089630 | A1 * | 4/2007 | Gordon | A63G 7/00 104/53 |
| 2008/0202374 | A1 * | 8/2008 | Muller | A63G 21/04 104/53 |
| 2009/0120319 | A1 * | 5/2009 | Muller | A63G 7/00 104/55 |
| 2009/0272289 | A1 * | 11/2009 | Baker | A63G 7/00 104/76 |
| 2010/0026484 | A1 * | 2/2010 | King | A63G 7/00 340/539.11 |
| 2010/0224098 | A1 | 9/2010 | Gordon | |
| 2013/0145953 | A1 * | 6/2013 | Crawford | A63G 31/16 104/28 |

FOREIGN PATENT DOCUMENTS

| | | | |
|---|---|---|---|
| CN | 2167751 | Y | 6/1994 |
| CN | 2338067 | Y | 9/1999 |
| CN | 2416940 | Y | 1/2001 |
| CN | 1347334 | A | 5/2002 |

(Continued)

OTHER PUBLICATIONS

Jun. 26, 2013, Search Report from European Patent Office in EP Application No. 13 163 907.2, which is the priority application to this U.S. application.

(Continued)

*Primary Examiner* — Adam Tissot
*Assistant Examiner* — Timothy Nesley
(74) *Attorney, Agent, or Firm* — Kolisch Hartwell, P.C.

(57) ABSTRACT

An embodiment of a rail vehicle may comprise at least one passenger receptacle; a device configured to generate a driving and/or braking force; a transmitting device for transmitting the driving and/or braking force onto a circuit; and at least one actuating device configured to exert a control over at least one of the vehicle's speed and acceleration. The transmitting device has a first engagement element configured for positive engagement with a compatible second engagement element arranged stationarily on the circuit, and a control unit. The control unit is configured to provide control signals to the device for generating the driving and/or braking force which are independent or dependent from the control exerted through the at least one actuating device. The control signals, at least intermittently, limit or shut off the control via the at least one actuating device or superimpose on the control via the at least one actuating device.

24 Claims, 3 Drawing Sheets

(56) References Cited

FOREIGN PATENT DOCUMENTS

| | | | |
|---|---|---|---|
| DE | 367410 | C | 1/1923 |
| GB | 1315047 | A | 4/1973 |
| WO | 2006079326 | A2 | 8/2006 |

OTHER PUBLICATIONS

Oct. 21, 2015, Office action from the State Intellectual Property Office of China in Chinese Patent Application No. 201410130663.5, which is a foreign application that shares the same priority as this U.S. application.

* cited by examiner

INTERACTIVE SPEED CONTROL

CROSS-REFERENCE TO RELATED APPLICATION

This application claims priority to European Patent Application No. 13163907.2, filed, Apr. 16, 2013, which is hereby incorporated by reference.

BACKGROUND

Fairground rides for amusement purposes are known in different variations. When it comes to conceiving amusement roller coasters, appeal and fun for the passenger are the primary considerations. There have therefore always been attempts to implement new ideas that give the passenger a special and new ride thrill.

Furthermore, there is the possibility of letting the passenger intervene directly in the operation of the ride by controlling the vehicle interactively. Thus, publication WO 002006079326A2 describes a roller coaster with interactive speed control exerted through a vehicle passenger.

The scope for increasing the appeal of the ride thereby is, however, limited in the case of conventional roller coasters with interactive speed control, because large safety distances must be observed between vehicles or the top speeds must be greatly restricted. In addition, relatively long acceleration sections and braking distances are required. The result is low utilization of the ride.

SUMMARY

One or more embodiments of the present disclosure relate to a rail vehicle, in particular for amusement purposes, comprising: a passenger receptacle; a device for generating the driving and/or braking force; a device for transmitting the driving and/or braking force onto the circuit, and an actuating device for controlling the speed and/or acceleration of the vehicle by a passenger accommodated in the passenger receptacle of the vehicle. In addition, one or more embodiments of the present disclosure relates to a transport system comprising such a vehicle; and a circuit with a guide device along which the vehicle is movably arranged.

An object of the present disclosure is to provide a vehicle and a transport system that support new modes of operation and circuit concepts that can improve utilization of the ride.

One or more embodiments of a rail vehicle, especially for amusement purposes, comprise: at least one passenger receptacle; a device for generating the driving and/or braking force; a device for transmitting the driving and/or braking force onto the circuit, and at least one actuating device for controlling the speed and/or acceleration of the vehicle by a passenger accommodated in the passenger receptacle of the vehicle. The device for transmitting the driving/accelerating and/or braking force has a first engagement element for positive engagement (positive fit) with a compatible, second engagement element arranged stationarily on the circuit. Also provided is a control unit which, as a function of default boundary conditions and/or the occupancy status of the circuit with vehicles and/or the speed and position of the vehicle and/or of other vehicles on the circuit, provides control signals to the device for generating a driving and/or braking force which are independent or dependent from the control exerted through the at least one actuating device, said control signals, at least intermittently, limiting the control via the at least one actuating device and/or, at least intermittently, shutting off the control via the at least one actuating device and/or, at least intermittently, superimposing on the control via the at least one actuating device.

With the aid of one or more embodiments of the present disclosure, it is possible to realize a number of new ride and game situations in which the passenger(s) have interactive control over the vehicle. Due to the positive (fit) drive, high acceleration too is possible in a wide range extending from high to low acceleration, whereas, in the case of conventional interactively controlled vehicles, acceleration is possible only over a much more limited range on account of the usual frictional transmission of the driving/braking forces. In the context of one or more embodiments of the present disclosure, it is possible for the first time to create ride situations, including between drivers of different vehicles, that were previously not possible due to the limited scope for acceleration and braking. Simultaneously with the large positive acceleration, the positive locking supports much higher braking acceleration. As a result, the braking distance is reduced and safety distances between the vehicles can be shortened, as a result of which more interactive game options become possible, such as chases. The shorter safety distances support simultaneous operation of more vehicles on the circuit, a fact which on the one hand increases the degree of excitement, as several participants are involved in a ride situation, and on the other, can increase the conveying capacity. The positive engagement and/or the gearing can be used for effective and strong acceleration and/or braking on short circuits.

In addition, in one or more embodiments, the positive drive supports highly precise (tooth-wise) positioning and control of the vehicle. The safety distances, which are monitored for example by a centralized control, can be reduced (while the same speed is maintained), as the fuzzy buffers needed in the case of conventional driving and transmission systems can be eliminated. Alternatively (or in addition) thereto, higher speeds can be achieved without the need to increase the safety distances and/or to increase these to the extent needed for conventional rides. In this way, the conveying capacity of one or more embodiments of the transport system is increased.

In one or more embodiments of the present disclosure, both during driving and braking ("controlled braking"), the positive engagement ensures that no losses arise through slippage of the drive wheel. Moreover, the low losses conduce to more energy-efficient operation of one or more embodiments of the vehicle and/or of one or more embodiments of the transport system than is the case for vehicles or transport systems conventionally powered by friction.

In one or more embodiments of the present disclosure, the control can give the vehicle additional, higher-level control signals, which are independent of or also dependent on the control exerted through the actuating device(s), an example of said signals being a starting signal (meaning that the vehicle is started in any event, even if the passenger is not actuating the actuating device). But there can be any control signals of the centralized/decentralized control which take precedence over control signals generated via the actuating device. In other words, under defined boundaries the centralized/decentralized control, which cannot be influenced by the passenger or only influenced to a limited extent, is in charge of the control exerted through the actuating device, i.e. the control signals of the centralized/decentralized control are prior-ranking to the control exerted through the actuating device. A passenger of the vehicle is not enabled to overrule the control signals of the centralized/decentralized control by actuation of the actuating device. Under defined circumstances, the passenger may influence the output of the control, but only to a predefined extent. For example, an automatic start and/or stop command for the station exit and/or the station entrance can be generated by the centralized/decentralized control, so that the vehicle automatically accelerates or decelerates to a defined extent. It is also possible to provide a centralized/decentralized control in which a ride curve for sections or the entire circuit has been saved, said ride curve specifying the speeds, accelerations (positive/negative), etc. which are realized by the device for transmitting the driving and/or braking force, provided that individual actuation is not performed by the passenger and/or this actuation lies outside permissible defaults. In addition, the control can be used for the purpose of complying with the maximum and minimum permissible speeds and accelerations on the circuit (perhaps even as a function of the position of the vehicle and/or other vehicles arranged on the circuit). In other words, the passenger may only influence the speed/acceleration/deceleration of the vehicle within a certain corridor. A fixed value or a range between maximum and minimum speed/acceleration, possibly as a function of position and/or of the status of the system (positions/speeds/status diagrams of other, multiple or all cars) can be specified and can either be necessarily imposed on a specific section of the circuit or, in certain conditions, can be superimposed on individual actuation. The centralized/decentralized control can thus be more or less complex and, to an extent depending on the status of the system, can act either absolutely or superimpose the actuation by the vehicle passenger.

In one or more embodiments of the present disclosure, each vehicle can be designed in principle to accommodate one or more passengers. Preferably, one or more passenger receptacles are provided; however, their upper number should be limited. Moreover, actuating devices or actuators can be provided for one, several or all passengers per vehicle. An interactive vehicle that especially has the fewest possible passengers per vehicle or per actuating unit is appealing. If several actuating units are installed per vehicle, the shared or also disparate actuation of the actuating units, e.g. via the control or also via a mechanical or electrical connection between the actuating units, can generate a common uniform drive command for the vehicle. The actuating units thus cooperate together, and, through a combination of the commands, a control signal is generated that generates a specific acceleration/speed of the vehicle.

In one or more embodiments of the present disclosure, the vehicle can have different designs. Thus, one or more embodiments of the vehicle with actuating device(s) can be coupled to one or more other vehicles, with or without actuating units.

In one or more embodiments of the present disclosure, the at least one actuating device for exerting control may comprise at least one actuator which can be actuated for the purpose of increasing, maintaining and/or reducing the speed.

In an embodiment, the at least one actuating device for exerting control can have at least one lever and/or a pedal that can be actuated for the purpose of accelerating the vehicle. Certain operating elements or actuators that are conceivable for the purpose of interactive control only make sense when used with a vehicle having positive-locking power transmission onto the circuit, in that the properties of positive locking are exploited in conjunction with interactive control/actuation/operation of the vehicle. Thus, special operator controls, such as rudder, bicycle pedals, hand-operated rotary cranks, etc., can be provided, the skillful actuation of which can control the speed, the acceleration intensity, the acceleration curve and/or the positioning of the vehicle.

In one or more embodiments of the present disclosure, the at least one actuating device for exerting control can comprise at least one booster-actuating device which can be actuated for the purpose of generating, as needed, an additional acceleration or deceleration, wherein the additional acceleration and/or deceleration is generated in addition to the acceleration/deceleration generated by actuation of the lever and/or the pedal or to the acceleration/deceleration generated by the centralized/decentralized control. The booster-actuating device can be activated not only in the case of non-actuation of the actuating device for exerting control or in the absence of control exerted through the centralized/decentralized control, but also during actuation of the actuating device for exerting control or during control exerted through the centralized/decentralized control. This means that accelerations/decelerations which are produced by different actuations/controls can be superimposed. The booster button allows extra high acceleration and/or deceleration. It is the positive drive which makes possible in the first place high accelerations (positive or negative), which are to be generated by a booster button, compared to friction drives.

In one or more embodiments of the present disclosure, the actuating device for exerting control can comprise in particular at least one rudder, a pedal and/or a rotary crank.

In one or more embodiments of the present disclosure, the vehicle can also have at least one display element and/or actuator that can be actuated for the purpose of carrying out a game, wherein as a function of the actuation a result is displayed and/or the ride performance of the vehicle is affected. The displays can be, e.g., optical and/or acoustic displays, and the passenger can realize and execute additional game elements and game situations with the help of the actuator. For example, game points can be collected and displayed when a button (actuator) is pressed at the right times, e.g. when a signal outside the circuit or on the display lights up. By actuating a corresponding coloured button as quickly as possible, the passenger can earn points and/or additionally affect the speed/acceleration. For example, incorrect operation could lead the vehicle to judder or brake. Moreover, it is conceivable to "reward" correct actuation of the actuator with additional speed/acceleration or (virtual) energy reserves for the purpose of moving/accelerating the vehicle.

In one or more embodiments of the present disclosure, when multiple passengers are accommodated in a vehicle, there is scope for those passengers who cannot interactively affect what is happening during the ride due to a lower number of corresponding actuators to play games during the ride by displays and/or actuators, with which, e.g., points can be earned and reward effects deployed, e.g., a high ranking in a list of scorers or an improvement/deterioration in the measured ride time in line with the number of points earned.

In one or more embodiments of the present disclosure, the vehicle can have a control with a memory for saving a ride profile. The ride profile substantially corresponds to the acceleration and braking curves, which, from the automatic control and/or control exerted through the operating elements (including booster actuator), can be selected and/or set individually by the passenger prior to the ride. The ride profile is implemented during the subsequent ride. The appeal of this option lies mainly in the large range of possible accelerations and speeds afforded by the positive engagement. In addition, optical and acoustic signals, displays and designs could be individually adjusted by the passenger prior to the ride.

In one or more embodiments of the present disclosure, the first engagement element can comprise at least one gear wheel. The gear wheel can have a plurality of teeth, which are made of plastic and/or are coated with plastic as a damping element. The first engagement element may have a plurality of rotatable members for rolling of the rotatable members at the second engagement element.

In one or more embodiments of the present disclosure, the rotatable members are provided with lower wear resistance than the counter-gearing. As a result, the bulk of the wear during operation occurs at these members. The configuration of the gearing at the drive wheel renders the gearing the "consumable part", while the counter-gearing arranged along the circuit can be used virtually without wear. The material of the contact surfaces of the wear parts is softer than that of the mating-contact surface. In this way, it is possible to control which of the gearing is subject to which type of wear. The rotatable members can each comprise at least one damping member which is arranged between the components of the rotatable members that are arranged so as to be movable towards each other. This not only serves to damp impacts, etc., but also effects the most accurate possible rolling off of the rollers on the counter-gearing. The suspension also supports flexible adjustment of the orientation of the cylinders at the contact surface, so that line contact is always achieved. This in turn improves the running properties of the gearing, and is thus tolerant of errors of pitch and tooth alignment as well as of axle spacing and axle tilting. Those components which can be moved towards one another can be directly decoupled by the interposition of the damping between the components capable of moving towards one another (as seen from the line of action), i.e. upstream of the bearing.

In one or more embodiments of the present disclosure, the vehicle can have a brake. This can act on the first engagement element, wherein the brake can be configured as an induction brake, an eddy current brake, friction brake (e.g., via a disc brake mounted at the shaft of the engagement element), or motor brake (either via the lower motor speed adjusted via the control, or regenerative braking). Braking action in these embodiments is achieved indirectly via the gear wheel, not directly via the running wheels. Thus, the braking action is independent of external conditions such as humidity, etc.

In one or more embodiments of the present disclosure, the vehicle may have a limited number of passenger receptacles for a corresponding number of passengers, such as a maximum of two, four, six or eight passenger receptacles.

In one or more embodiments of the present disclosure, the actuating unit or actuating units preferably have one or more actuators, such as one actuator per passenger.

One or more embodiments of the transport system comprise: a vehicle as described above, and a circuit with a guide device along which the vehicle is movably arranged, wherein the circuit has a second engagement element with which the first engagement element engages in positive locking.

One or more embodiments of the transport system comprise: a vehicle having a passenger receptacle, a device for generating a driving and/or braking force, a device for transmitting the driving and/or braking force onto the circuit, and at least one actuating device for exerting control over the speed and/or the acceleration of the vehicle by a passenger accommodated in the passenger receptacle of the vehicle, wherein the device for transmitting the driving and/or braking force has a first engagement element for positive engagement with a compatible second engagement element stationarily arranged on the circuit; a circuit with a guide device, along which the vehicle is movably arranged, wherein the circuit has a second engagement element with which the first engagement element positively engages; and a control unit, which, as a function of predetermined boundary conditions and/or the occupancy status of the circuit with vehicles and/or the speed and position of the vehicle and/or other vehicles on the circuit, provides control signals to the device for generating a driving and/or braking force which are dependent or independent from the control exerted through the at least one actuating device, said signals, at least intermittently, limiting the control via the at least one actuating device, and or, at least intermittently, switching off the control via the actuating device and/or, at least intermittently, superimposing on the control via the at least one actuating unit.

In one or more embodiments of the present disclosure, the positive (fit) drive makes possible precise (tooth-wise) positioning and control of the vehicle. Through reduced safety distances, not only can higher accelerations/speeds than in conventional rides be created, the conveying capacity of one or more embodiments of the transport system is also increased.

One or more embodiments of the transport system make possible further game variants requiring precise controllability of the vehicle. Compared with traditional rides, various possibilities for designing roller coasters arise. Thus, games are conceivable in which winning depends on exerting the most accurate control over the vehicle, e.g., maintaining a certain maximum speed, braking with pinpoint accuracy to avoid an obstacle, etc. Also, races in which the aim is to achieve the best possible lap times are soon exhausted in the absence of the varied ride opportunities afforded by the positive engagement. But it is also possible to render the design of the circuit, too, more variable, as shorter braking distances and acceleration sections must be provided if the predetermined speeds are to be attained and the same fun generated. The circuit can moreover be made more variable by a positive drive and/or a positive delay device (e.g. brake), since a positive drive/braked vehicle can drive steep gradients (almost to vertical).

In one or more embodiments of the present disclosure, the second engagement element can be configured as a toothed rack.

In one or more embodiments of the present disclosure, the second engagement element can be arranged stationarily along the circuit and extend at least in sections along the circuit.

In one or more embodiments of the present disclosure, the second engagement element may have counter-gearing that is compatible with a first engagement element.

In one or more embodiments of the present disclosure, the control can be configured as a centralized control and/or as a vehicle-mounted decentralized control, which assumes at least some of the tasks of the centralized control. A strictly centralized control is therefore possible which cooperates with a subunit in the form of, say, a motor or brake control of the vehicle, a hybrid composed of centralized and decentralized control, or a strictly decentralized control. Where there is a plurality of communicating decentralized controls, one of the controls can be a "master" control that takes on higher-level tasks while the other controls can be "slave" controls.

One or more objects of the present disclosure is/are achieved with a vehicle in accordance with one or more embodiments of the present disclosure.

BRIEF DESCRIPTION OF THE FIGURES

Further advantages and characteristics of one or more embodiments of the present disclosure will become apparent from the description with reference to the figures.

DETAILED DESCRIPTION

One or more embodiments described below relate to a rail passenger transport system. The transport system can, however, be used in any other application for which it is suitable. It is particularly useful for amusement rides, i.e. for amusement purposes.

Figure 1:
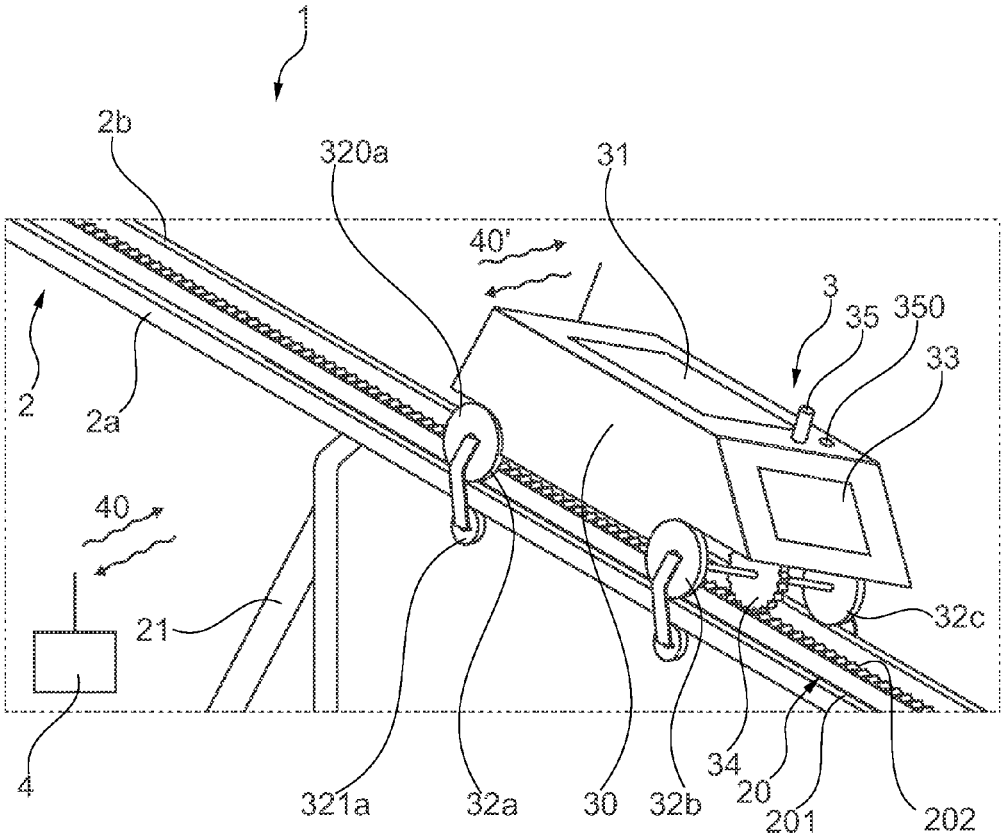
FIG. 1 is a perspective view of a section of an embodiment of a passenger rail-transport system in accordance with the present disclosure.

FIG. 1 shows an embodiment of a passenger transport system 1 in accordance with the present disclosure. The transport system 1 comprises a circuit/track 2 having two parallel rails 2*a* and 2*b* for guiding twin-track vehicles 3 along the circuit 2. In addition, the circuit has a second engagement element 20, e.g. in the form of a toothed rack, centrally located between the rails 2*a*, 2*b*. The engagement element extends especially in sections along the circuit 2, preferably along the entire circuit 2.

In addition, the transport system 1 comprises one or more vehicles 3 arranged on the circuit, which are movable on the rails 2*a*, 2*b* and along the circuit 2. The exemplary vehicle 3 shown in FIG. 1 comprises a chassis 30 with a passenger receptacle 31 for accommodating at least one passenger.

The vehicle 3 further has four running wheels 32*a*, 32*b*, 32*c* (the fourth wheel is not visible). Each of the running wheels 32*a*, 32*b*, 32*c*, as exemplified by the first running wheel 32*a*, substantially comprises a main running wheel 320*a*, which sits on the rail 2*a* and/or 2*b*, and an auxiliary running wheel 321, which engages under the rail 2*a* and/or 2*b* to prevent the vehicle 3 from lifting off the circuit 2.

Each of the vehicles 3 arranged on the circuit 2 is provided with a drive 33, e.g. an electric motor. The drive 33 transmits the drive force produced by it onto a first engagement element 34, such as a gear wheel. This engages with the second engagement element 20, which is arranged stationarily along the circuit 2. As a result, the driving force is positively transmitted from the first engagement element 34 onto the second engagement element 20. The vehicle 3 can thus be driven or braked via the first engagement element 34, so that the vehicle 3 can be (positively or negatively) accelerated or the speed maintained.

In accordance with an embodiment of the present disclosure, the vehicle 3 has an actuator 35 in the form of a lever, with which the vehicle passenger by actuating the same can control the drive 33 and thus the movement of the vehicle 3. Thus, there is an interactive control, which enables the vehicle passenger to influence or to determine the ride performance of the vehicle 3. Instead of or in addition to the lever, a foot-actuated pedal can be provided, such as in the form of an accelerator pedal.

In one or more embodiments of transport system 1, therefore, the vehicle 3 comprises a drive 33 and a gear wheel 34 which engages with counter-gearing 20 arranged stationarily on the circuit 2, such that positive power transmission takes place.

Moreover, additional actuators 350 can be provided which can be actuated by the vehicle passenger in order to influence the ride performance. In the illustrated embodiment, the additional actuator 350 is a booster button. When this is pressed, the motor 33 intermittently generates an additional driving force, which allows additional acceleration of the vehicle 3.

In addition, an actuator can be provided for the purpose of braking (not shown), such as in the form of a brake pedal to reduce the speed of the vehicle 3. The brake can act upon one or more running wheels or, preferably, on the first engagement element. The brake could also act directly on the circuit if it is configured, e.g., as an eddy current brake or as a shoe brake encircling the ride tube.

The combination of (interactive) speed control of the vehicle 3 by the vehicle passenger with a positive drive 33, 34 makes possible new movement characteristics. In particular—as opposed to a conventional friction drive—greater accelerations (positive and negative) can be realized. In addition, more accurate position detection and control of the vehicle 3 along the circuit 2 is possible.

Preferably, the transport system 1 can have a centralized control 4 arranged outside the vehicle at or in the vicinity of the circuit 2 that takes on control functions, e.g. to ensure a minimum distance between the individual vehicles as a function of the constellation and speed of the vehicles 3 arranged along the circuit 2. Through the positive drive 33, 34, the braking and acceleration distance can be calculated more accurately and maintained. Moreover, higher acceleration forces (positive and negative) can be transmitted from the circuit 2 to the vehicle 3. As a result, minimum distances can be lowered relative to transport systems having other drives and utilized capacity of the transport system 1 increased.

Instead of the centralized control 4, or in addition to the centralized control 4, a decentralized control, that is, a control mounted on the vehicle 3 can be provided which assumes all or some of the sub-tasks of the centralized control 4.

If a minimum distance is not adhered to, the centralized control 4 can, by sending signals 40, 40' to the vehicle 3, (intermittently) exert an influence on the control of the drive 33, e.g. in that a maximum speed for a particular vehicle 3 is specified or the latter is decelerated. Signal transmission can, as shown in FIG. 1, occur wirelessly or via a wire (not illustrated) extending along the circuit 2.

Figure 2:
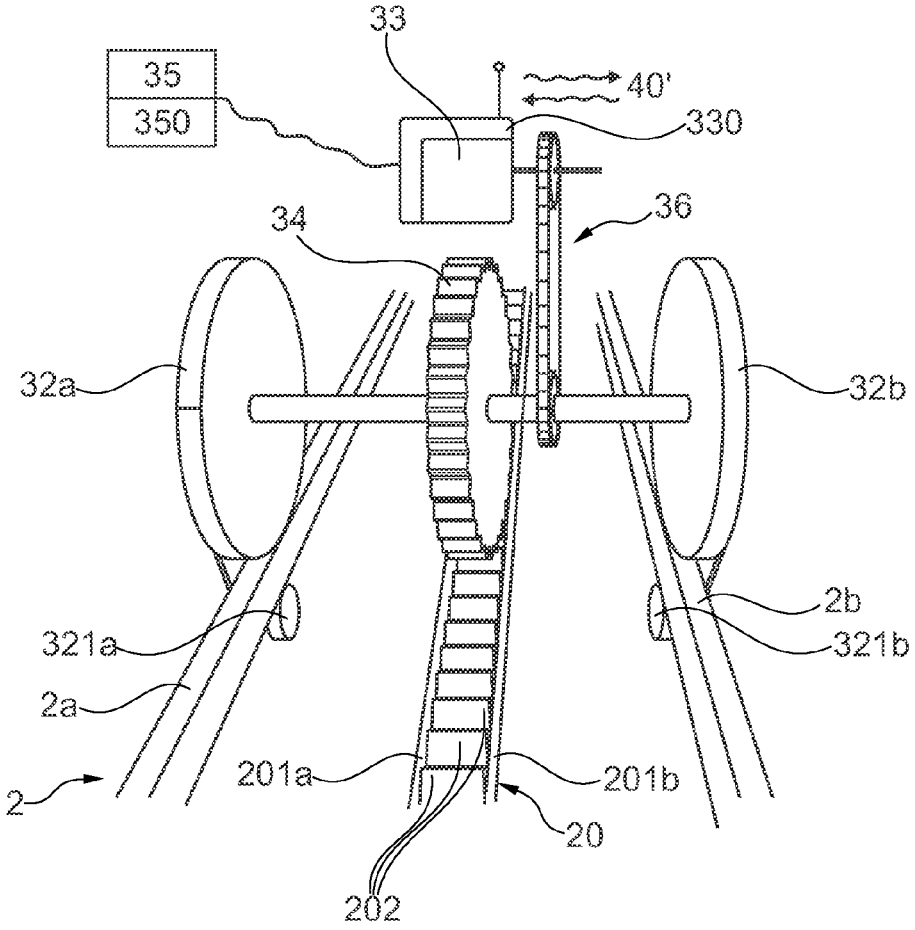
FIG. 2 is a perspective view of a section of an embodiment of the positive drive in accordance with the present disclosure.

FIG. 2 is a partial schematic drawing of details of an embodiment of the positive drive 33 and/or the positive transmission of forces from the drive 33 onto the circuit 2.

The circuit 2 comprises rails 2*a*, 2*b*, and a second engagement element 20 located centrally between the rails. The engagement element 20 includes two laterally arranged brackets 201*a*, 201*b*, between which is arranged gearing (some of the teeth are indicated by the reference numeral 202). The gearing 202 substantially comprises teeth arranged equidistantly along the circuit 2 and recesses there-between. The gearing 202 is configured so as to be compatible with the gearing of the gear wheel 34 of the vehicle 3. The positive drive and transmission system comprises the drive 33. The force generated by the drive is transmitted by a suitable transmission 36 onto the gear 34 and from this onto the stationary counter-gearing 202 of the circuit 2. The gear wheel 34 has radially projecting, circumferentially equidistant teeth and recesses. The teeth can be made of plastic or be coated with plastic to reduce wear of the counter-gearing 202 of the circuit 2. The gear wheel 34 can, if needed, be replaced or its gearing repaired.

The drive is interactively controlled by one (or more) passengers of the vehicle 3 via actuators 35, 350. The actuators 35, 350 preferably act on the drive 33 via a drive control 330. A centralized control (not shown) can, through signals 40', exchange data with the drive 33 (or its control 330) and, where necessary, take on or influence control of the drive 33. If, instead of the centralized control 4, or in addition to the centralized control 4, a decentralized control, that is, a control mounted on the vehicle 3 is provided, which takes on all or some sub-tasks of the centralized control 4, signals 40' can be exchanged and/or transmitted between the decentralized controls of different vehicles 3 and/or the centralized control.

One or more embodiments of the present disclosure relate to a transport system 1 that comprises rails 2*a*, 2*b* for rail-bound movement of a vehicle 3 along the circuit 2. The vehicle 3 has a device for generating a driving and/or braking force 33 and a gear wheel 34 which engages with gearing 20 arranged stationarily on the circuit 2, such that positive power transmission takes place. The device 33 for generating a driving and/or braking force can be controlled interactively by one or more vehicle passengers by an actuating device 35, 350.

Figure 3:
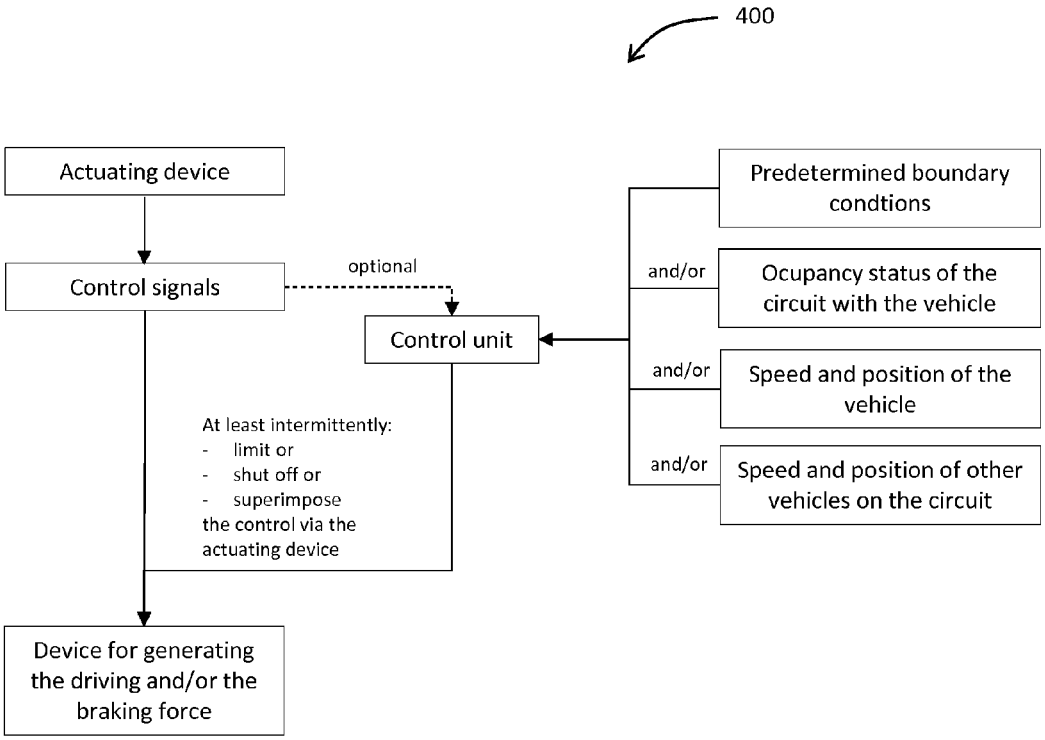
FIG. 3 is a flow chart depicting steps of an illustrative method for exerting control over a rail vehicle in accordance with the present disclosure.

FIG. 3 is a flow chart depicting an illustrative method, generally indicated at 400, for exerting control over a rail vehicle. Method 400 may be performed in conjunction with a passenger transport system according to aspects of the present disclosure. Although various steps of method 400 are described below and depicted in FIG. 3, the steps need not necessarily all be performed.

One or more embodiments of the present disclosure may include one or more of the following concepts:

A. A rail vehicle (3), especially for amusement purposes, comprising: at least one passenger receptacle (31); and a device (33) for generating a driving and/or braking force; a device for transmitting the driving and/or braking force onto the circuit; and at least one actuating device for exerting control over at least one of the speed and the acceleration of the vehicle (35, 350) by at least one passenger of the vehicle (3) accommodated in the passenger receptacle (31), wherein the device for transmitting the driving and/or braking force has a first engagement element (34) for positive engagement with a compatible second engagement element (20) arranged stationarily on the circuit; and a control unit (4) which, as a function of at least one of predetermined boundary conditions, the occupancy status of the circuit (2) with vehicles (3), the speed and position of the vehicle (3), and the speed and position of other vehicles (3) on the circuit (2), provides control signals to the device (33) for generating a driving and/or braking force which are independent or dependent from the control exerted through the at least one actuating device (35, 350), said control signals, at least intermittently, limiting the control via the at least one actuating device (35, 350) or, at least intermittently, shutting off the control via the at least one actuating device (35, 350) or, at least intermittently, superimposing on the control via the at least one actuating device (35, 350).

B. The vehicle (3) in accordance with Paragraph A, wherein the actuating device for exerting control comprises at least one actuator (35, 350) which can be actuated for the purpose of at least one of increasing, maintaining and reducing the speed.

C. The vehicle (3) in accordance with Paragraph A, wherein the actuating device for exerting control has at least one of a lever (35) and a pedal that can be actuated for the purpose of accelerating the vehicle (3).

D. The vehicle (3) in accordance with Paragraph A, wherein the actuating device for exerting control comprises at least one booster actuating device (350) which can be actuated for the purpose of generating additional acceleration and/or an additional delay.

E. The vehicle (3) in accordance with Paragraph A, wherein the actuating device for exerting control comprises at least one of a rudder, a pedal and a rotary crank.

F. The vehicle (3) in accordance with Paragraph A, wherein the vehicle (3) has at least one of a display element and an actuator that can be actuated for the purpose of carrying out a game, wherein as a function of the actuation a result is displayed and/or the ride performance of the vehicle (3) is influenced.

G. The vehicle (3) in accordance with Paragraph A, wherein the vehicle (3) has a control with a memory for saving a ride profile.

H. The vehicle (3) in accordance with Paragraph A, wherein the vehicle (3) has a computer unit for selecting and adjusting at least one of optical and acoustic signals displayed during the ride.

I. The vehicle (3) in accordance with Paragraph A, wherein the vehicle (3) has a brake that can act on the first engagement element (20), wherein the brake is configured especially as an induction brake, friction brake, motor brake or eddy current brake acting on the engagement element.

J. The vehicle (3) in accordance with Paragraph A, wherein the vehicle (3) has a limited number of passenger receptacles (31) for a corresponding number of passengers, in particular a maximum of eight passenger receptacles (31), preferably a maximum of four passenger receptacles (31), especially a maximum of two passenger receptacles (31).

K. A transport system (1) comprising: a vehicle (3) in accordance with Paragraph A; and a circuit (2) with a guide device (2*a*, 2*b*) along which the vehicle (3) is movably arranged, wherein the circuit (2) has a second engagement element (20) with which the first engagement element (34) engages in positive locking.

L. The transport system (1) in accordance with Paragraph K, characterized by the fact that the second engagement element (20) is arranged stationarily along the circuit (2) and extends at least in sections along the circuit (2).

M. The transport system (1) in accordance with Paragraph K, characterized by the fact that the second engagement element (20) has counter-gearing (202) that is compatible with the first engagement element (34).

N. The transport system (1) in accordance with Paragraph K, characterized by the fact that the control (4) is configured as a centralized control or as a vehicle-mounted decentralized control or partly centralized and partly vehicle-mounted decentralized control, wherein the (partly) decentralized control assumes at least some of the tasks of the centralized control.

O. A transport system (1) comprising: a vehicle (3) having a passenger receptacle (31), a device (33) for generating a driving and/or braking force, a device for transmitting the driving and/or braking force onto the circuit, and at least one actuating device for exerting control over at least one of the speed and the acceleration of the vehicle (35, 350) by at least one passenger accommodated in the passenger receptacle (31) of the vehicle (3), wherein the device for transmitting the driving and/or braking force has a first engagement element (34) for positive engagement with a compatible second engagement element (20); a circuit (2) with a guide device (2*a*, 2*b*), along which the vehicle (3) is movably arranged, wherein the circuit (2) has a second engagement element (20) with which the first engagement element (34) positively engages; and a control unit (4), which, as a function of at least one of predetermined boundary conditions, the occupancy status of the circuit (2) with vehicles (3), the speed and position of the vehicle, and the speed and position of other vehicles (3) on the circuit (2) provides control signals to the device (33) for generating a driving and/or braking force which are dependent or independent from the control exerted through the at least one actuating device (35, 350), said signals, at least intermittently, limiting the control via the at least one actuating device (35, 350), or, at least intermittently, switching off the control via the actuating device (35, 350) or, at least intermittently, superimposing on the control via the at least one actuating unit (35, 350).

P. The transport system (1) in accordance with Paragraph O, characterized by the fact that the second engagement element (20) is arranged stationarily along the circuit (2) and extends at least in sections along the circuit (2).

Q. The transport system (1) in accordance with Paragraph O, characterized by the fact that the second engagement element (20) has counter-gearing (202) that is compatible with the first engagement element (34).

R. The transport system (1) in accordance with Paragraph O, characterized by the fact that the control (4) is configured as a centralized control or as a vehicle-mounted decentralized control or partly centralized and partly vehicle-mounted decentralized control, wherein the (partly) decentralized control assumes at least some of the tasks of the centralized control.

Protection is sought for all of these characteristics, both individually and in combinations with each other.

The disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A rail vehicle for amusement purposes, comprising:

at least one passenger receptacle;

a device configured to generate at least one of a driving force and a braking force;

a transmitting device for transmitting at least one of the driving force and the braking force onto a circuit; and at least one actuating device configured to control the device configured to generate at least one of the driving force and the braking force, wherein the actuating device is actuated by at least one passenger of the vehicle accommodated in the passenger receptacle to exert a control over at least one of a speed and an acceleration of the vehicle, wherein the transmitting device has a first engagement element configured for positive engagement with a compatible second engagement element arranged stationarily on the circuit; and a control unit which, as a function of at least one of predetermined boundary conditions, an occupancy status of the circuit with the vehicle, a speed and a position of the vehicle, and a speed and a position of other vehicles on the circuit, is configured to provide one or more control signals to the device for generating at least one of the driving force and the braking force which are independent or dependent from the control exerted through the at least one actuating device, and further wherein the one or more control signals are configured to, at least intermittently, limit the control via the at least one actuating device or, at least intermittently, shut off the control via the at least one actuating device or, at least intermittently, superimpose on the control via the at least one actuating device.

2. The vehicle of claim 1, wherein the actuating device for exerting the control comprises at least one actuator which can be actuated for the purpose of at least one of increasing the speed, maintaining the speed, and reducing the speed.

3. The vehicle of claim 1, wherein the actuating device for exerting the control has at least one of a lever and a pedal that can be actuated for the purpose of accelerating the vehicle.

4. The vehicle of claim 1, wherein the actuating device for exerting the control comprises at least one booster actuating device which can be actuated for the purpose of generating at least one of an additional acceleration and an additional delay.

5. The vehicle of claim 1, wherein the actuating device for exerting the control comprises at least one of a rudder, a pedal and a rotary crank.

6. The vehicle of claim 1, wherein the vehicle has at least one of a display element and an actuator that can be actuated for the purpose of carrying out a game, further wherein, as a function of the actuation, at least one of a result is displayed and the ride performance of the vehicle is influenced.

7. The vehicle of claim 1, wherein the vehicle has a control with a memory for saving a ride profile.

8. The vehicle of claim 1, wherein the vehicle has a computer unit for selecting and adjusting at least one of optical and acoustic signals displayed during the ride.

9. The vehicle of claim 1, wherein the vehicle has a brake that can act on the first engagement element, wherein the brake is configured as one of an induction brake, a friction brake, a motor brake and an eddy current brake acting on the engagement element.

10. The vehicle of claim 1, wherein the vehicle has a maximum of eight passenger receptacles configured for receiving a maximum of eight passengers.

11. A transport system comprising:

the vehicle of claim 1; and the circuit with a guide device along which the vehicle is movably arranged, wherein the circuit has the compatible second engagement element with which the first engagement element engages in positive locking.

12. The transport system of claim 11, wherein the compatible second engagement element is arranged stationarily along the circuit and extends at least in sections along the circuit.

13. The transport system of claim 11, wherein the compatible second engagement element has counter-gearing that is compatible with the first engagement element.

14. The transport system of claim 11, wherein the control is configured as at least one of a centralized control, a vehicle-mounted decentralized control, and a partly centralized and partly vehicle-mounted decentralized control, wherein at least one of the decentralized control and the partly decentralized control assumes at least some of the tasks of the centralized control.

15. The vehicle of claim 1, wherein the transmitting device is configured to transmit at least one of the driving force and the braking force onto a circuit which is a continuous track.

16. The vehicle of claim 1, wherein the device configured to generate at least one of the driving force and the braking force is a motor.

17. The vehicle of claim 1, wherein the first engagement element is a circular engaging driving wheel and the second engagement element is a toothed rail.

18. A transport system comprising:

a vehicle having a passenger receptacle, a device adapted to generate at least one of a driving force and a braking force, a device adapted to transmit at least one of the driving force and the braking force onto a circuit, and at least one actuating device adapted to control the device adapted to generate at least one of the driving force and the braking force, wherein the actuating device is actuated by at least one passenger of the vehicle accommodated in the passenger receptacle to exert a control over at least one of a speed and an acceleration of the vehicle wherein the actuating device for exerting the control comprises at least one actuator which can be actuated for the purpose of at least one of increasing the speed, maintaining the speed, and reducing the speed, wherein the device adapted to transmit at least one of the driving force and the braking force has a first engagement element adapted for positive engagement with a compatible second engagement element of a circuit with a guide device, along which the vehicle is movably arranged, further wherein the circuit has the compatible second engagement element with which the first engagement element positively engages; and a control unit, which, as a function of at least one of predetermined boundary conditions, an occupancy status of the circuit with the vehicles, a speed and a position of the vehicle, and a speed and a position of other vehicles on the circuit, is adapted to provide one or more control signals to the device to generate at least one of the driving force and the braking force which are dependent or independent from the control exerted through the at least one actuating device, and further wherein the one or more control signals are adapted to, at least intermittently, limit the control via the at least one actuating device, or, at least intermittently, switch off the control via the actuating device or, at least intermittently, superimpose on the control via the at least one actuating unit.

19. The vehicle of claim 18, wherein the transmitting device is configured to transmit at least one of the driving force and the braking force onto a circuit which is a continuous track.

20. The transport system of claim 18, wherein the compatible second engagement element is arranged stationarily along the circuit and extends at least in sections along the circuit.

21. The transport system of claim 20, wherein the compatible second engagement element has counter-gearing that is compatible with the first engagement element.

22. The transport system of claim 21, wherein the control is configured as at least one of a centralized control, a vehicle-mounted decentralized control, and a partly centralized and partly vehicle-mounted decentralized control, wherein at least one of the decentralized control and the partly decentralized control assumes at least some of the tasks of the centralized control.

23. The transport system of claim 18, wherein the compatible second engagement element has counter-gearing that is compatible with the first engagement element.

24. The transport system of claim 18, wherein the control is configured as at least one of a centralized control, or as a vehicle-mounted decentralized control, and a partly centralized and partly vehicle-mounted decentralized control, wherein at least one of the decentralized control and the partly decentralized control assumes at least some of the tasks of the centralized control.

* * * * *